US006112463A

United States Patent [19]

Reithmeyer et al.

[11] Patent Number: 6,112,463

[45] Date of Patent: Sep. 5, 2000

[54] REINFORCING MEMBERS FOR TILTING SASH TYPE WINDOW SYSTEM

[75] Inventors: Joseph Guy Reithmeyer, Afton; Mark Steven Hudoba, Hugo, both of Minn.

[73] Assignee: Andersen Corporation, Bayport, Minn.

[21] Appl. No.: 09/205,485

[22] Filed: Dec. 4, 1998

[51] Int. Cl.[7] ..... E05D 15/22

[52] U.S. Cl. ..... 49/183; 49/161

[58] Field of Search ..... 49/183, 184, 453, 49/454, 438, 428, 161

[56] References Cited

U.S. PATENT DOCUMENTS

| | | | |
|---|---|---|---|
| 699,919 | 5/1902 | Haberle | 49/183 |
| 3,676,956 | 7/1972 | Taylor et al. | 49/454 X |
| 4,356,667 | 11/1982 | Malachowski . | |
| 4,521,991 | 6/1985 | Sayer et al. . | |
| 4,622,778 | 11/1986 | Simpson . | |
| 4,624,073 | 11/1986 | Randall . | |
| 4,813,180 | 3/1989 | Scalzi | 49/161 |
| 4,955,159 | 9/1990 | Rogers | 49/161 |
| 4,961,286 | 10/1990 | Bezubic . | |
| 5,014,466 | 5/1991 | Winner . | |
| 5,544,450 | 8/1996 | Schmidt et al. . | |
| 5,546,702 | 8/1996 | deNormand et al. . | |
| 5,551,189 | 9/1996 | Westfall . | |
| 5,592,781 | 1/1997 | Mauro . | |

OTHER PUBLICATIONS

Lincoln DP40 tilt pin description (date unknown); 1 page.

"StormGUARD Hardware Instructions", MW Manufacturers, Inc., Rocky Mount, VA, Aug. 1997; 5 pages.

*Primary Examiner*—Daniel P. Stodola
*Assistant Examiner*—Hugh B. Thompson
*Attorney, Agent, or Firm*—Merchant & Gould P.C.

[57] ABSTRACT

A window including a frame, a side jamb liner, a sash, and a reinforcing member. The reinforcing member includes a base portion mounted to a top surface of a check rail of the sash and an upright portion extending vertically from the base portion. The upright portion engages the rib of the side jamb liner when the side jamb liner is in a first position. The side jamb liner can be laterally displaced to a second position, where the rib will not engage the upright portion. The reinforcing member is made of a unitary piece of material.

10 Claims, 4 Drawing Sheets

FIG. 2
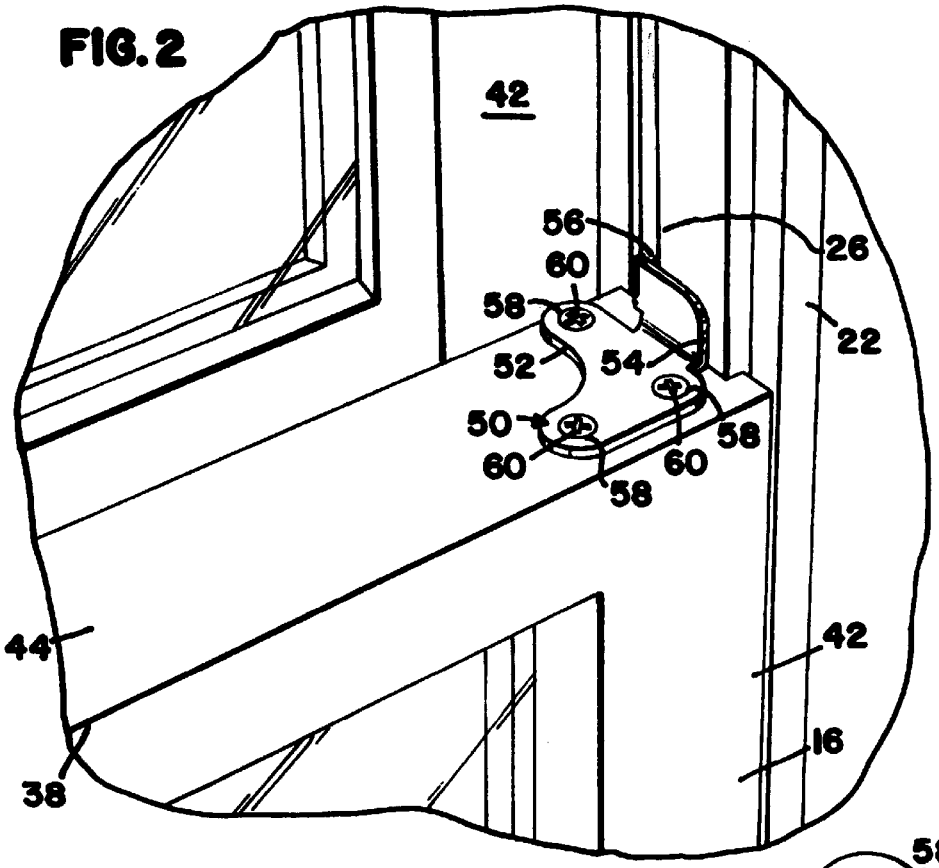
FIG. 3C
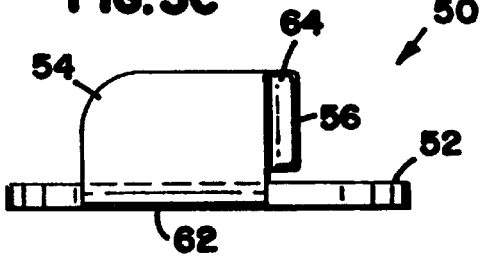
FIG. 3A
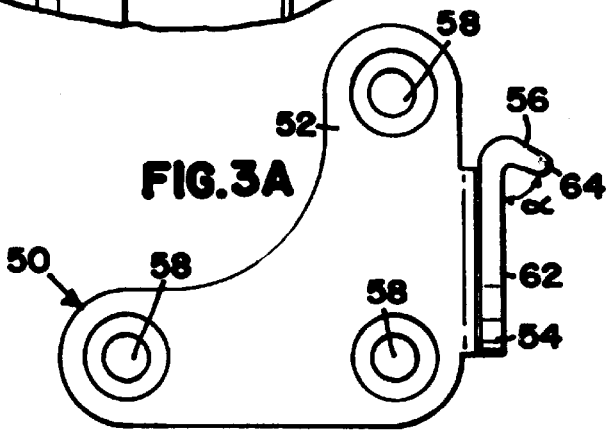
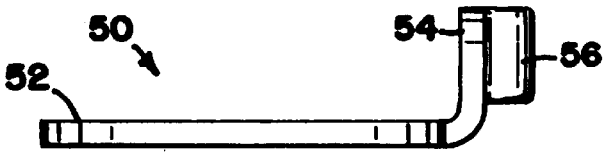
FIG. 3B

REINFORCING MEMBERS FOR TILTING SASH TYPE WINDOW SYSTEM

FIELD OF THE INVENTION

The present invention is directed to a device for reinforcing windows, and more particularly to a reinforcing member for a double-hung tilting sash type window.

BACKGROUND OF THE INVENTION

Tilting sash double-hung window assemblies have been developed that allow the sash to tilt inward. It is therefore possible for a person inside a building to access both sides of the window's pane of glass for easy cleaning. One mechanism that is commonly used to allow for tilting windows is a movable side jamb liner. In a typical system, a device is provided behind the side jamb liner near the bottom check rail, so that the side jamb can be laterally displaced from a first position to a second displaced position. In the first position, the side jamb liner is in sliding engagement with the side of the sash. In the second position, the side jamb liner is laterally displaced so that the side jamb liner does not engage the top part of the window sash. The window may also include devices to assist with displacing the side jamb liner, or it can simply be displaced by pushing against the liner.

In the typical tilting window system, the side jamb liner includes a rib that projects from the face of the side jamb liner toward the window sash. The rib is received in a groove in the side of the window sash. The groove is present on the sides of the window sash. To allow the sash to tilt inward, the rib of each side jamb liner is laterally displaced, so that the rib is not engaged with the sash groove.

Because the tilting window sash engages a movable rib to hold the sash in place within the frame, high wind pressures applied against the window pane may present a problem. The window sash may occasionally bow inward when under a large load perpendicular to the window pane. The check rail of the lower window sash may also bow when the window is subjected to a large pressure, and the sash side or the movable side jamb liner may suffer compression and/or deformation, and may in some cases release the sash from engagement with the jamb liner causing the sash to tilt inward. There is a need for a device to increase the load bearing capability of tilting windows.

One known device to improve the load bearing ability of tilting windows is a bolt system, where a sliding bolt is mounted to the check rail of the lower sash. A slot may be provided in the window frame, for receiving the sliding bolt. The bolts then provide additional attachment of the sash to the jamb liner. However, the bolts are only effective if they are moved into position to engage the slots prior to a storm or high wind occurring. Further, in the event of a fire or other emergency, the two sliding bolts must be released before the window is opened, in addition to opening the window closure between the upper and lower sash, in order to exit through the window. There is a need for a reinforcing member for a tilting window that does not need to be activated in order to provide reinforcement and that allows for the normal operation of the window, especially during emergencies.

Many tilting windows are currently installed in areas where building codes have recently changed to increase the required load bearing capacity of windows. There is a need for reinforcing members for tilting windows that can be added on to existing installed tilting window systems.

SUMMARY OF THE INVENTION

Generally the present invention provides for a window including a frame, a side jamb liner having a rib projecting from a front face, where the jamb liner is laterally movable from a first position to a second position, and a sash. The sash includes two opposing sides and a check rail. The sash sides have a groove for receiving the rib of the adjacent jamb liner, to slidably mount the sash in the frame. A reinforcing member is included, having a base portion mounted to the top surface of the check rail of the sash and an upright portion extending vertically from the base portion. The upright portion engages the rib when the side jamb liner is in the first position and the reinforcing member is made of a unitary piece of material.

In one particular embodiment of the invention, the upright portion of the reinforcing member includes a lip portion that is aligned with the sash groove, allowing the lip portion to engage the rib along a length of the lip.

BRIEF DESCRIPTION OF THE DRAWINGS

The invention may be more completely understood by considering the detailed description of various embodiments of the invention which follows in connection with the accompanying drawings.

FIG. 2 shows a perspective view of the reinforcing member of the present invention, installed on the right side of a check rail of a window, as viewed from the inside of an installed window.

FIG. 3A is a top plan view of one embodiment of the reinforcing member of the present invention.

FIG. 3B is a side view of the reinforcing member of FIG. 3A.

FIG. 3C is an end view of the reinforcing member of FIG. 3A.

Figure 1:
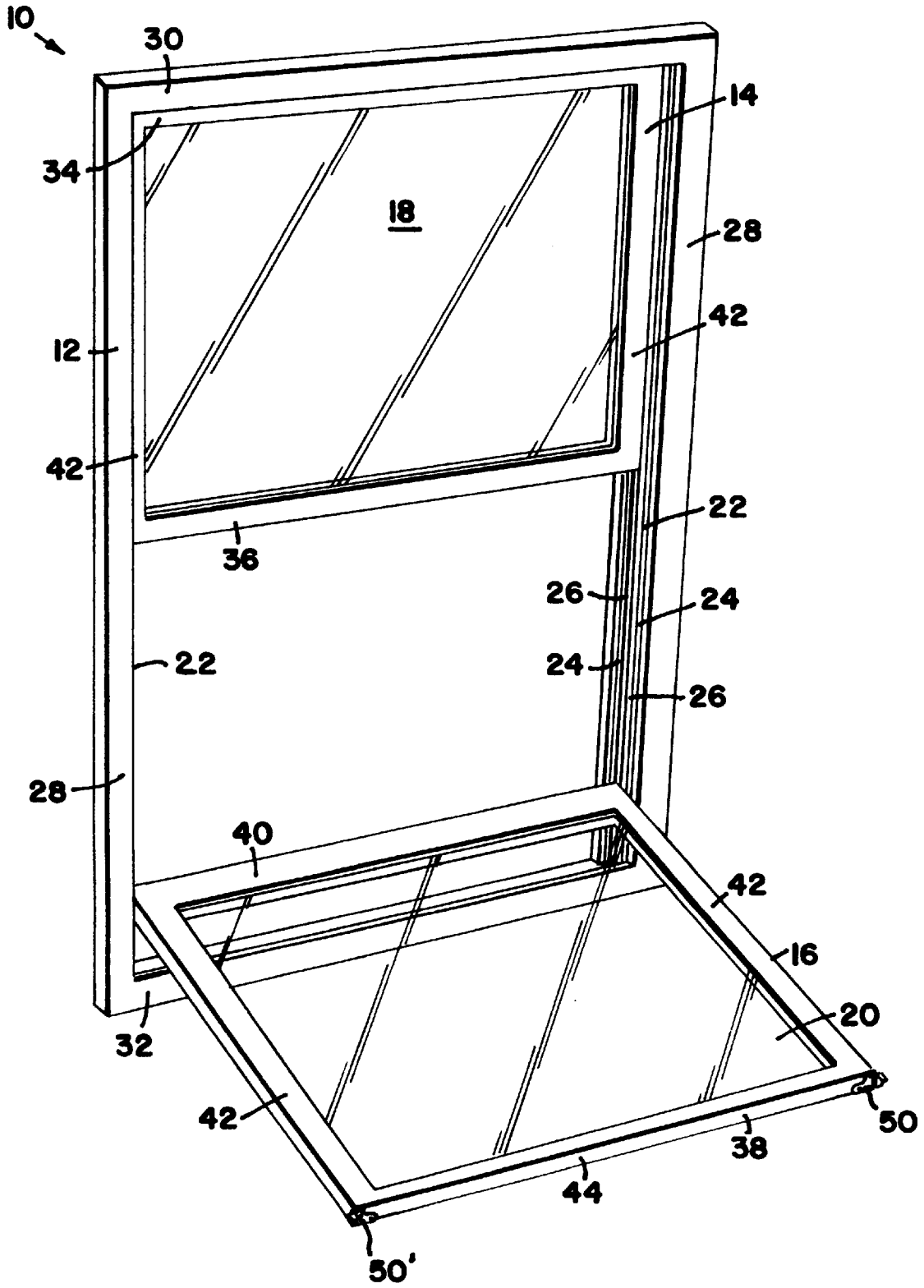
FIG. 1 shows a window of the present invention where the lower sash is tilted inward, viewed from the inside of an installed window.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims.

DETAILED DESCRIPTION OF THE VARIOUS EMBODIMENTS

The present invention is believed to be applicable to a variety of systems and arrangements for tilting windows. The invention has been found to be particularly advantageous in application environments where high load bearing windows are required, such as in windy coastal areas or in crowded metropolitan areas where tall buildings cause increased wind speeds. The invention is a reinforcing member that provides increased wind load bearing capability to tilting sash windows and permits normal operation of the window without manipulating the reinforcement member. While the present invention is not so limited, an appreciation of various aspects of the invention is best gained through a discussion of various application examples operating in such an environment.

Referring now to the drawings, where like referenced numbers indicate identical or corresponding parts through the several views, FIG. 1 illustrates one particular embodiment in which a double-hung tilting sash window 10 has a frame 12. The frame 12 supports upper sash 14 and lower sash 16, each sash having window panes 18 and 20, respectively. The frame 12 also has two oppositely disposed jamb liners 22. Each jamb liner has two jamb channels 24 and each jamb channel 24 has at least one rib 26 projecting from a front face of the jamb liner 22 along the length of the jamb liner.

Jamb liners 22 are mounted for lateral movement away from the proximate sides of sashes 14 and 16. This lateral displacement of jamb liners can be accomplished by pushing against the jamb liner or with the aid of a device for laterally displacing the jamb liners. Such a device may include either a wash-assist ramp, hooked wash-assist, camming wash-assist, or biased wash-assist ramp. U.S. Pat. No. 5,544,450 describes devices for laterally displacing jamb liners 22, and is hereby incorporated by reference in its entirety.

Although the jamb liner is referred to as being laterally displaced, only the portion of the jamb liner that engages the sash needs to be displaced in order to allow the sash to tilt. In the embodiment shown in the Figures, only the rib 26 needs to be laterally displaced to allow tilting of the sash.

Frame 12 has two oppositely disposed side members 28, a top member 30, and a bottom member 32, all operably connected by means well known in the art. Window 10 and frame 12 have an inside that is facing front in FIG. 1, and an outside which is disposed opposite to the inside. Upper sash 14 has a top rail 34 and an upper check rail 36. Lower sash 16 has a lower check rail 38 and a bottom rail 40. Disposed on the opposite sides of each sash 14 and 16 are side members or stiles 42.

Reinforcing members 50 are mounted to a top surface 44 of the check rail 38 of the lower sash 16. Now referring to FIG. 2, a reinforcing member 50 on the right side of the sash is shown in greater detail. A similar reinforcing member 50' is positioned on the left side of the sash, configured to engage the left side jamb liner. The left side reinforcing member is discussed in relation to FIG. 6. Reinforcing member 50 includes a base portion 52 that is mounted to the top surface 44 of check rail 38. Reinforcing member also includes an upright portion 54 extending vertically from base portion 52. The upright portion engages the rib 26 of the jamb liner 22. In some embodiments of the present invention, the upright portion includes a lip portion 56 that provides the engaging contact with the rib 26.

The base portion 52 of the reinforcing member 50 can be mounted to the top surface 44 of the check rail 38 using a variety of attachment methods that are known in the art. In the embodiment pictured in FIG. 2, the base portion 52 is mounted to the top surface 44 using three screws. The screws 60 are received in holes 58. Preferably, three holes 58 are provided in the reinforcing member 50 for mounting to the top surface 44. More preferably, the three holes are arranged so that there are two holes in each direction along the base 52, as shown in FIG. 2.

FIGS. 3A–3C show various views of the reinforcing member 50. The lip portion 56 may be curved to more securely engage the rib 26. The base portion 52 includes an end edge 62 that is closest to the jamb liners 22. The lip 56 forms an angle $\alpha$ with the end edge 62 of the base portion 52. The end edge 62 is parallel to the side of the stiles 42. The angle a results in improved engagement between the reinforcing member 50 and the side jamb liner 22. The angle $\alpha$ may be approximately 60 to 80 degrees in one embodiment, and is preferably about 70 degrees.

Preferably, the lip 56 has a rounded end 64. The rounded end 64 of the lip 56 helps reduce the likelihood of the lip 56 damaging or deforming the rib 26. The lip 56 has a length along the end 64, and the lip 56 engages the rib 26 along the length of the lip.

Figure 4:
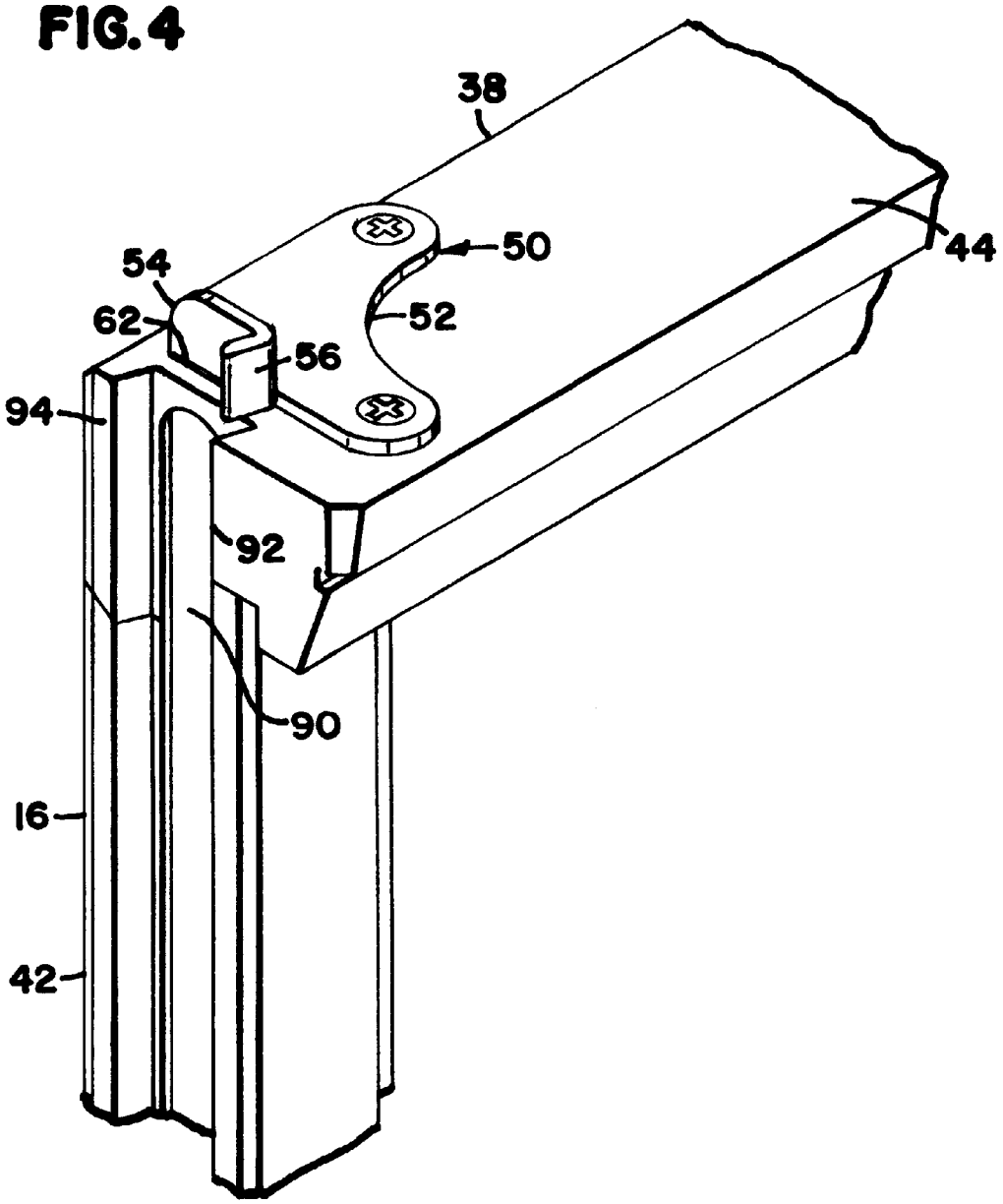
FIG. 4 is an end perspective view of the reinforcing member of FIG. 3A installed on a window sash.

FIG. 4 shows the reinforcing member 50 situated on the top surface 44 of check rail 38. The stile or side member 42 of the lower sash 16 includes a sash groove 90. The sash groove 90 is designed to mate with the rib 26, to allow for sliding engagement between the lower sash 16 and the side jamb liners 22. The sash groove 90 is defined by outside sash groove wall 92 and inside sash groove wall 94. As shown in FIG. 4, the lip 56 is aligned with the sash groove 90, and more specifically, is aligned with outside sash groove wall 92.

The sash groove 90 may be defined along the entire length of the sash side, may be defined only at the top portion of the sash side, or may be defined along various lengths of the sash side, depending on the type of tilting double hung window assembly that is used in connection with the reinforcement member of the present invention. Any of these variations of the tilting type window could be used with the present invention, without effect on the construction or use of the reinforcing member.

Figure 6:
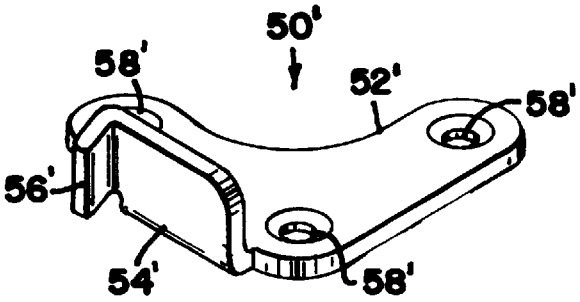
FIG. 6 is a perspective view of the left side reinforcing member of the present invention.

The left side reinforcing member 50' is similar to the right side reinforcing member 50, as shown in FIG. 6, but is designed to engage the left side jamb liner. A base portion 52' is mounted at the left end of the check rail 38 and an upright portion 54' extends vertically from the base portion 52'. A lip portion 56' is configured to engage the left side jamb liner. Further, holes 58' are defined in the base portion for mounting to the check rail.

Figure 5A:
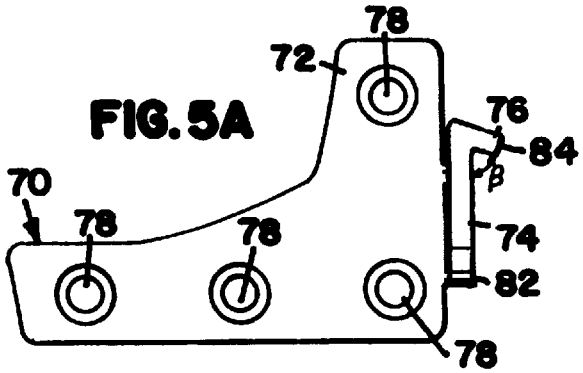
FIG. 5A is a top plan view of a second embodiment of the reinforcing member of the present invention.
Figure 5B:
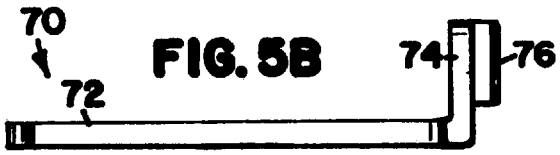
FIG. 5B is a side view of the reinforcing member of FIG. 5A.
Figure 5C:
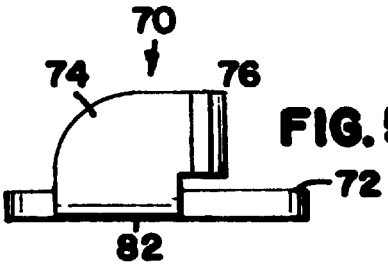
FIG. 5C is an end view of the reinforcing member of FIG. 5A.

A second embodiment 70 of the reinforcing member is illustrated in FIGS. 5A–5C. Reinforcing member 70 also includes a base portion 72 and an upright portion 74. Further, the upright portion 74 may include a lip portion 76 that is designed to engage with the rib 26. The base 72 includes four holes 78 to facilitate mounting to the top surface 44 of the check rail 38. In one particular embodiment, three of the holes 78 are positioned to lie along a line that is parallel to the rail, while two of the four holes lie in the direction perpendicular to the rail. This configuration provides additional strength in the mounting of the reinforcing member 70 to the check rail 38 compared to the embodiment of FIG. 3A.

Base 72 includes an end edge 82 that is closest to the side jamb liner when the reinforcing member 70 is installed. The lip portion 76 forms an angle $\beta$ with the end edge 82. As discussed in relation to the first embodiment of the reinforcing member 50, the angle $\beta$ improves secure engagement with the rib 26. The angle $\beta$ may be approximately 60 to 80 degrees in one embodiment, and more preferably about 70 degrees. Preferably, the lip 76 has an end edge 84. The lip 76 has a length along the end edge 84, and the lip 76 engages the rib 26 along the length of the lip 76.

The reinforcing member of the present invention is preferably made of a unitary piece of material for simple manufacture and installation. The material of the reinforcement member may be selected so that it does not compress or deform when subjected to the design pressure requirements for a particular window where it will be installed. Preferably, the reinforcing member is made of metal for inexpensive manufacturing, although many other materials are possible and have other advantages.

The reinforcing bracket of the present invention will improve the engagement between the lower sash 16 and the jamb liners 22 in at least two ways: by increasing the surface area of contact between the sash and the jamb liners and by providing a relatively non-compressible and relatively non-deforming member on the sash that bears load against and effectively transfers load to the side jamb liner. Another advantage provided by the unitary construction is the ease of manufacture provided.

The reinforcing member of the present invention is designed to be installed simply and easily even after a window unit is present in a building. The installation of the reinforcing member on the top surface 44 of check rail 38 insures that installation can be performed even after a window unit is installed in a building. Another advantage of the reinforcing member of the present invention is that it will not interfere with normal operation of the window. The lower sash 16 is still capable of engagement with the jamb liners 22. The upright portion of the reinforcing member is capable of sliding along the jamb liner 22 as the sash is moved up and down without interfering with movement. Further, the tilting operation of the window is also possible even when the reinforcing member is installed. To tilt the window inward, the side jamb liner 22 is laterally displaced, removing the rib 26 from engagement with the sash groove 90. As the side jamb liner 22 is laterally displaced, it will also lose engagement with the reinforcing member.

Another advantage of the reinforcing member of the present invention is that once it is installed, no further manipulation is needed in order for the reinforcement to be provided. A window user does not need to remember to take additional action, such as engaging a bolt, to reinforce the window before a storm begins.

The reinforcing member of the present invention is preferably made of steel, with thickness of approximately 0.05 to 0.15 inches, preferably about 0.09 inches. In the preferred embodiment, the steel of the reinforcing member will be thermal cold rolled and cold quenched according to ASTM A336. Preferably, steel AISI 1008/1010 may be used as the material for the reinforcing member. In order to provide an attractive and durable external surface, the reinforcing member is preferably finished with electro-deposited zinc chromate and powder coated for color. Many finishing techniques are known in the art and may be used with the present invention to provide an attractive finish surface that is durable and capable of being safely handled.

When installing the reinforcing member of the present invention using screws, a template is preferably used to correctly position the drill holes. The template may have tabs to easily and reliably position the template against the end of the check rail. The template also has holes to indicate where drill holes should be placed in the check rail, so that the upright portion of the reinforcing member will engage the rib of the side jamb liner and will not interfere with normal operation of the window. The drill holes can be made in the check rail through the holes in the template.

The various embodiments described above are provided by way of illustration only and should not be construed to limit the invention. Those skilled in the art will readily recognize various modifications and changes which may be made to the present invention without strictly following the exemplary embodiments and applications illustrated and described herein and without departing from the true spirit and scope of the present invention which is set forth in the following claims.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A window comprising:

(a) a frame having at least two side members, a top member and a bottom member;

(b) a side jamb liner, approximately parallel to and operably connected to each frame side member, the jamb liner having a rib projecting from a front face, the jamb liner being laterally movable from a first position to a second position;

(c) a sash having at least two opposing sides and a check rail having a top surface, each side having a sash groove for receiving the rib of the adjacent jamb liner to slidably mount the sash in the frame, wherein the rib is engaged with the sash groove when the jamb liner is in the first position and wherein the rib is at least partially retracted from the groove when the jamb liner is in the second position; and (d) a reinforcing member comprising a base portion mounted on the top surface of the check rail of the sash and an upright portion that includes a lip portion aligned with the sash groove, wherein the lip portion engages the rib along a length of the lip portion, the upright portion extending vertically from the base portion, the upright portion engaging the rib when the side jamb liner is in the first position, wherein the reinforcing member is made of a unitary piece of material;

wherein the sash resists tilting under a horizontal load unless the jamb liners are moved from the first position to the second position.

2. The window of claim 1 where the lip portion is curved toward the rib.

3. The window of claim 1 where the base portion includes an end edge closest to the jamb liner when the sash is in the first position and the lip portion forms an angle of approximately 60 to 80 degrees between the lip portion and the end edge of the base portion.

4. The window of claim 1 where the base portion includes an end edge closest to the jamb liner when the sash is in the first position and the lip portion forms an angle of approximately 70 degrees between the lip portion and the end edge of the base portion.

5. The window of claim 1 where the base portion defines three holes for mounting the reinforcing member to the check rail.

6. The window of claim 1 where the base portion defines four holes for mounting the reinforcing member to the check rail.

7. The window of claim 6 where at least three of the holes are positioned in a line that is parallel to the check rail.

8. The window of claim 1 where the reinforcing member is made of a unitary piece of metal.

9. The window of claim 8 where the reinforcing member includes steel.

10. A tilting window comprising a reinforcing member, where the tilting window includes a frame having a side member and said side member includes a rib projecting from a front face, the rib being laterally movable from a first position to a second position, and a sash having a side member and a check rail having a top surface, said side member having a sash groove for receiving the rib to slidably mount the sash in the frame, wherein the rib is engaged with the sash groove when the rib is in the first position and wherein the rib is at least partially retracted from the groove when the rib is in the second position, said reinforcing member comprising:

a base portion, mounted on the top surface of the check rail of the sash, and an upright portion that includes a lip portion aligned with the sash groove, wherein the lip portion engages the rib along a length of the lip portion, the upright portion extending vertically from the base portion, the upright portion engaging the rib when the side jamb liner is in the first position, the upright portion disengaging the rib when the side jamb liner is in the second position, wherein the reinforcing member is made of a unitary piece of material.

* * * * *